United States Patent [19]

Drejza et al.

[11] 4,397,576

[45] Aug. 9, 1983

[54] PRINT HEAD ACTUATOR

[75] Inventors: John E. Drejza, Charlotte, N.C.; Donald F. Manning; Joseph T. Wilson, III, both of Endicott, N.Y.

[73] Assignee: International Business Machines Corporation, Armonk, N.Y.

[21] Appl. No.: 332,799

[22] Filed: Dec. 21, 1981

[51] Int. Cl.[3] ..... B41J 25/30

[52] U.S. Cl. ..... 400/320; 400/120; 400/323

[58] Field of Search ..... 400/320, 120, 323; 346/139 R, 139 A

[56] References Cited

U.S. PATENT DOCUMENTS

| | | | |
|---|---|---|---|
| 2,141,975 | 12/1938 | Finch | 346/139 A |
| 3,646,570 | 2/1972 | Drapeau | 346/139 R |
| 3,826,915 | 7/1974 | Giolitti et al. | 400/120 X |
| 3,845,850 | 11/1974 | Herr et al. | 400/120 |
| 4,288,168 | 9/1981 | Mayr et al. | 400/323 X |
| 4,343,012 | 8/1982 | Knapp | 400/323 X |

*Primary Examiner*—Clifford D. Crowder

*Attorney, Agent, or Firm*—Kenneth P. Johnson

[57] ABSTRACT

Apparatus for moving a print heat of a serial matrix printer into or out of contact with a recording medium in which the required motion is achieved during translation of the print head along the print line by a cam and follower and in which the contact pressure of the print heat is resiliently maintained.

8 Claims, 3 Drawing Figures

PRINT HEAD ACTUATOR

FIELD OF THE INVENTION

This invention relates generally to printers and more particularly to apparatus for positioning the print head on a recording medium from a retracted position.

BACKGROUND OF THE INVENTION

Serial matrix printers such as the thermal, electrolytic or electroerosion types require contact between the recording medium and print head to effectuate marking. The print head mechanism is typically moved to the actuating or retracted positions by either the energization or release of a solenoid. Examples of such print head actuators are shown in U.S. Pat. Nos. 4,225,251 and 3,509,980.

The actuation of a print head by solenoid usually results in an extremely rapid change in the print head position, creating noise and wear due to the impact of either the print head carrier or the solenoid itself. The rapid action also requires a significant amount of energy which necessitates a power supply of greater capacity and increased expense. In addition, control of the solenoids to operate the print head mechanism at the desired times requires additional circuits for the necessary logic. Solenoid energization is required generally for the length of the print line and if a series of print lines is being recorded, problems of heating which hasten deterioration or failure of the solenoid may occur.

OBJECTS AND SUMMARY OF THE INVENTION

It is accordingly a primary object of this invention to eliminate the need for a solenoid actuator and to provide a mechanism employing the motion of the print head and its carrier along the print line to move the print head between an extended position on the recording medium and a retracted or rest position.

Another object of this invention is to provide a print head actuating mechanism which is capable of bringing the print head into gradual engagement with the recording medium thus avoiding the sudden impact heretofore experienced.

The foregoing objects are attained in accordance with the invention by providing print head carrier means translatable along support means transversely of and parallel to a recording medium with said carrier means having a pair of arm portions with cam followers thereon engageable with cam means, said carrier means including a print head means resiliently urged toward said recording medium and being restrained by one of said cam follower arms according to the profile of said cam means. As the cam means allows said one cam follower arm to move in one direction about said support means, the print head means moves into engagement with the recording medium due to the urging of resilient means. The relative motion between the print head and its carrier is limited so that the print head and carrier yieldingly engage the recording means but are positively withdrawn.

This invention has the advantage of positive control of the impact velocity of the print head so that quiet contact occurs with the recording medium. A further advantage is that the drive motor used for translating the print head also causes the print head motion with respect to the recording medium resulting in improved energy and component efficiencies.

The foregoing and other objects, features and advantages of the invention will be apparent from the following more particular description of the preferred embodiments of the invention as illustrated in the accompanying drawing.

DESCRIPTION OF THE PREFERRED EMBODIMENT

Figure 1:
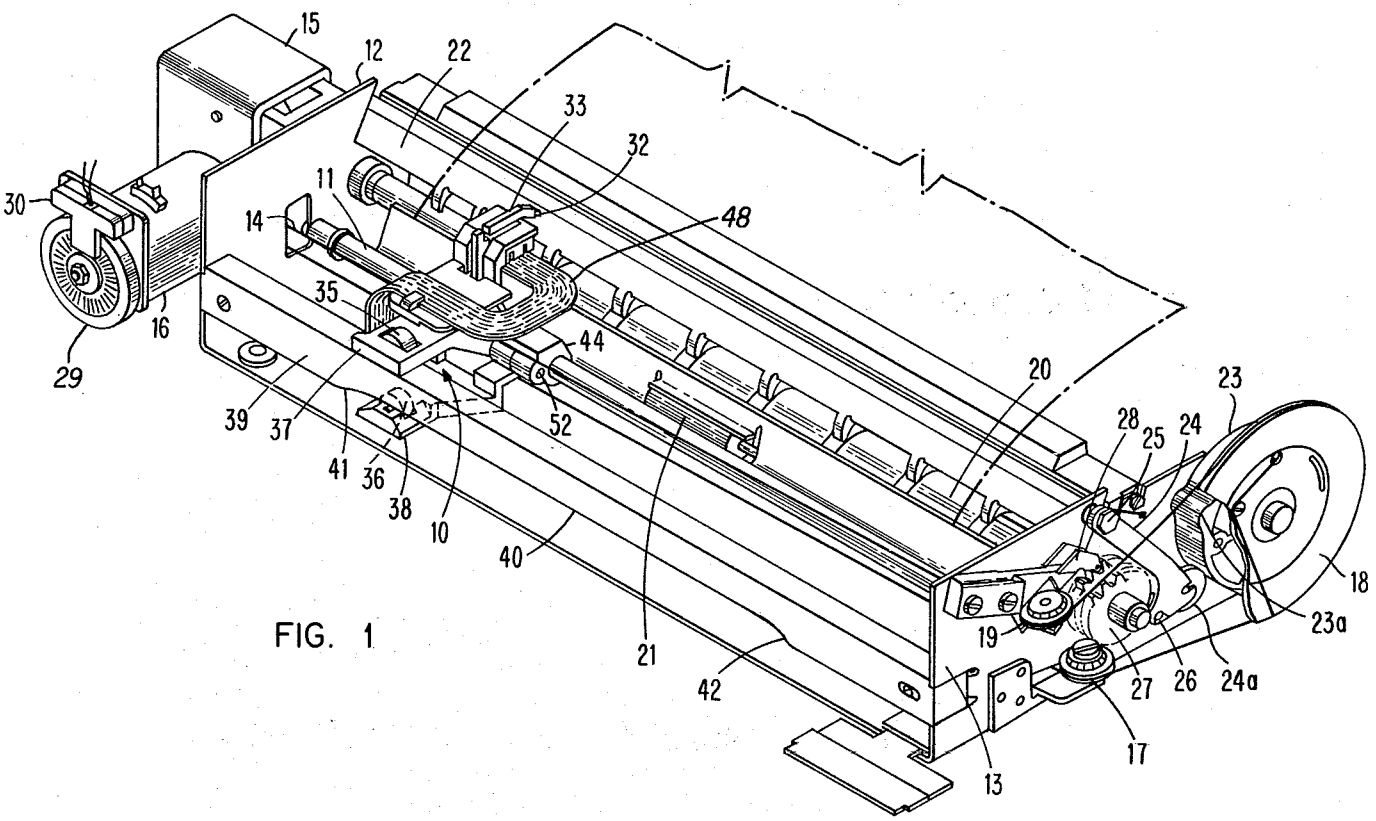
FIG. 1 is a schematic isometric view of a serial matrix printer having a print head carrier constructed in accordance with the principles of the invention.

Referring to FIG. 1, there is shown a serial matrix printer of the electroerosion type having a print head carrier unit, indicated generally as 10, translatable along a supporting guide rod 11, fixed between side frames 12 and 13. Carrier unit 10 is moved along rod 11 by a cable 14 and entrained from the carrier unit to a driving capstan, not shown within bracket 15, attached to reversible servomotor 16 and returned beneath the carrier unit to idler pulley 17, cam drive capstan 18 and idler pulley 19 to the opposite side of the carrier unit. Metallized paper (shown in phantom) is inserted beneath feed roll 20 and is gripped by a grounded pinch roll 21 so as to advance across platen 22 when the feed roll is incrementally rotated.

Movement of cable 14 by motor 16 causes cam drive capstan 18 to rotate cam lobe **23*a* of cam 23 against follower roller 24*a* supported on arm 24 pivoted about pin 25. Arm 24 carries pawl 26 which engages a tooth of ratchet 27 and advances the paper one print line, overcoming detent 28 which also serves as an antibackup pawl. The cam lobe and print head carrier unit are relatively arranged along cable 14 so that paper advancement occurs when carrier unit 10 reaches either end of a print line traversal. Cam 23 will thus make slightly more than one revolution during a full traversal of carrier unit 10. Motor 16 carries an optical timing disk 29 with sensing unit 30 detecting the opaque and transparent portions of the disk during rotation of the motor. The resulting pulses are used by circuits not shown to determine the location of the carrier unit 10** along the print line.

Printing is accomplished by moving electrodes 32 on print head 33 supported on print head carrier unit 10 into contact with the paper on platen 22 at the beginning of a new line. A metallized paper printer is used for illustration. The plurality of electrodes are each energized as necessary to erode or burn away a small spot of the metal on the paper to expose a contrasting underlying color. The electrodes are arranged in a pair of spaced interleaved rows normal to the print head motion to thereby form the character matrix of small eroded spots during translation across the paper. At the end of the print line, the print head and electrodes are lifted from the paper. After the paper is incremented, the motor direction is reversed and the print head and electrodes are moved in the opposite direction, first being lowered to the paper for recording and being drawn to the opposite edge of the paper and again lifted.

The print head movement toward and away from the paper is accomplished by a pair of cam follower rollers 35 and 36 supported in respective follower arms 37 and 38 which engage linear cam 39. The cam profile along the lower edge is narrower in the area corresponding to the print line and allows lower follower arm 38 to move upward and bring electrodes 32 into contact with the paper. Each ramp portion 41 and 42 of the cam profile serves to both lower and raise the print head, depending upon the direction in which carrier unit 10 is being drawn.

Figure 2:
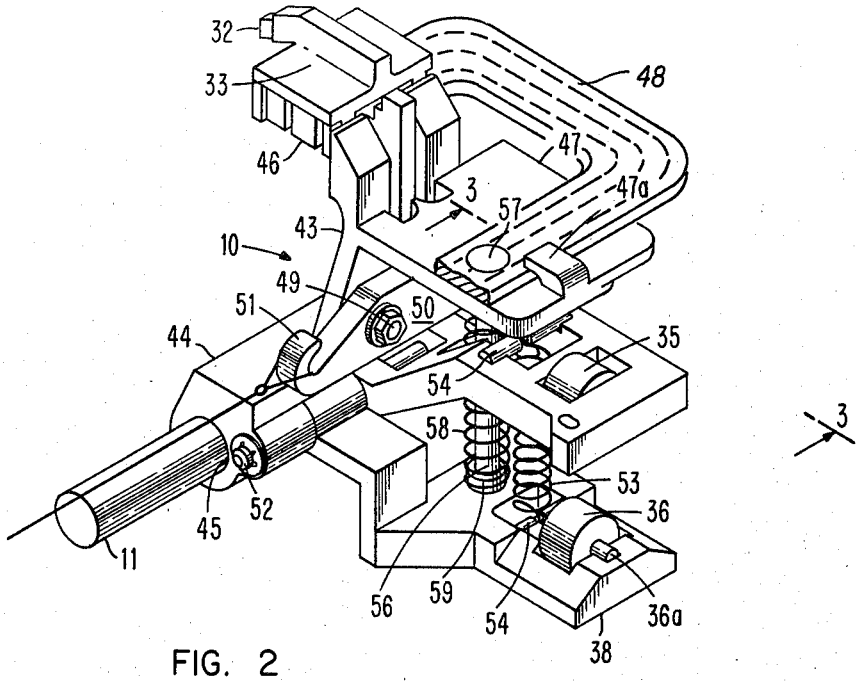
FIG. 2 is a schematic isometric view of the print head carrier in FIG. 1 shown in greater detail.
Figure 3:
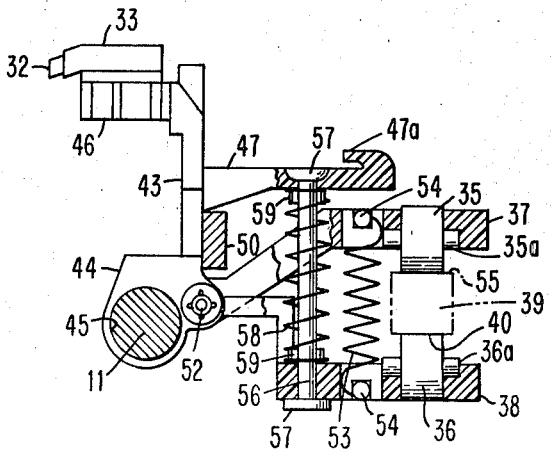
FIG. 3 is a sectional view of the print head carrier of FIG. 2 taken along the lines through 3—3.

Print head carrier unit 10 is shown in greater detail in FIGS. 2 and 3. The carrier unit generally comprises a print head carrier bracket 43 having a base portion 44 with opening 45 to accommodate guide bar 11 along which the braket can slide and about which the bracket can pivot. Bracket 43 further has supports 46 and 47 integral therewith on which are mounted print head 33 and ribbon cable 48 via clip 47*a*. Secured by a pair of fasteners 49 to the bracket is a cable anchor 50 having a hook 51 at either end to which is connected opposite ends of cable 14 for translating the print head bracket along the guide rod 11.

Base portion 44 of the bracket also carries a pivot pin 52 on which upper follower arm 37 and lower follower arm 38 are each supported. Cam follower rollers 35 and 36 each rotate on respective integral stub shafts or journals 35*a* and 36*a* which bear in recesses within the follower arms. A tension spring 53 connected between anchor pins 54 urges the two follower arms together holding their respective rollers in engagement with the respective upper cam surface 55 and lower cam surface 40.

A tie pin 56 having enlarged ends 57 extends between the top surface of cable support 47 and the lower surface of follower arm 38 thus limiting the maximum separation of these two elements. A compression spring 58, held in position by bosses 59, urges the support and, hence, carrier bracket 43 away from lower follower arm 38. Spring 58 and pin 56, however, permit carrier bracket 43 to move clockwise or toward lower carrier arm 38. The function of spring 58 is to limit the amount of force with which electrodes 32 are urged against the paper therewith to the rate of spring 58 when in contact with the paper.

In operation, upper follower arm 37 with cam follower roller 35 in contact with cam surface 55 travels in the same plane throughout the length of cam 39. However, it will be seen in FIG. 1 that lower follower arm 38 with roller 36 changes elevation at ramp 41 or 42 and moves from a thicker or lower cam portion at the ends to a thinner or higher point therebetween. As the print head carrier unit 10 is moved from an end portion of the cam toward the beginning of a print line, follower arm 38 moves upwardly due to the action of tension spring 53. This raises tie rod 56 thus allowing spring 58 to rotate carrier bracket and the print head counterclockwise (FIGS. 2 and 3) into contact with paper on platen 22. Tie rod 56 will no longer be effective during printing since carrier bracket 43 and lower follower arm 38 will be held in their relative positions by the opposing actions of springs 53 and 58. Spring 53, of course, has the higher spring force. As the print head carrier unit reaches the opposite end of cam 40, the lower cam arm will be forced downwardly so that tie rod 56 will retract carrier bracket 43 from the paper. Spring 58 is used to produce the desired loading of the print head on the paper to allow for variations in distances during travel and to permit wider tolerance of the component dimensions.

Although the upper and lower follower arm portions have been shown as being pivoted about shaft 52 on the base portion 44 of the carrier bracket, the follower arm portions can instead pivot about guide rod 11. Arms 37 and 38 may also rotate on cylindrical projections on carrier unit 44 that are concentric with opening 45. This latter arrangement will provide a fixed relationship between the pivot point and the rollers on cam 39 but increases the sliding friction on rod 11. A further modification is that of linking the carrier bracket 43 to the upper cam follower portion. This will necessitate a reconfiguration of the upper follower arm profile to provide adequate distance between the support portion 47 and upper follower arm 37 and provide the proper spring force urging the electrodes against the metallized paper. In this latter instance, the cam, of course, would incorporate the actuating lobes on its upper surface 55 while the lower surface 40 would lie within a single plane.

There has been disclosed a cam arrangement which permits elimination of the usual solenoid actuating device for print head and which simplifies the control necessary for advancing and retracting the print head relative to the print line. Many of the print head carrier unit components can be molded thus facilitating inexpensive fabrication. Further, the actuating profile of cam 39 can be modified to produce the desired acceleration and decceleration of the head as it approaches the print medium or is retracted therefrom.

While the invention has been particularly shown and described in reference to a preferred embodiment thereof, it will be understood by those skilled in the art that foregoing and other changes in form in details may be made therein without departing from the spirit and scope of the invention.

What is claimed is:

1. In a printer having a print station for supporting a medium on which a line of indicia is to be recorded, recording apparatus comprising:

support means spaced from and parallel to said line of indicia;

carrier means translatable along and rotatable about said support means and including cam follower means and recording means resiliently biased toward said medium; and cam means extending along said support means and having at least one cam surface continuously engaging said follower means for moving said recording means at each end of said line between a retracted position out of contact with said medium and an operating position resiliently engaging said medium during translation of said carrier means.

2. Apparatus as described in claim 1 wherein said cam means includes a guide surface and a cam surface on opposite sides of an elongate member.

3. In a printer having a print station for supporting a medium on which a line of indicia is to be recorded, recording apparatus comprising:

support means spaced from and parallel to said line of indicia;

carrier means translatable in either direction along and rotatable about said support means and including a pair of cam follower means resiliently biased toward each other and recording means resiliently supported on one said follower means and biased toward said medium; and a cam extending along said support means in continuous engagement with both said follower means and having a profile effective during said translation for moving said recording means at each end of said line between a retracted position out of contact with said medium and an operating position resiliently engaging said medium.

4. Apparatus as described in claim 3 further including a compression spring for urging said recording means away from one of said follower portions and link means for limiting the separation.

5. Apparatus as described in claim 3 wherein said carrier means further includes means for translating said carrier means along said support means.

6. Apparatus as described in claim 5 further including means for advancing said medium at each end of said line when said carrier means is retracted therefrom.

7. Apparatus as described in claim 6 wherein said medium advancing means is independently operable by said translating means during the movement of said carrier means.

8. Apparatus as described in claim 3 wherein only one of said cam follower portions is operable to retract said recording means from said medium.

* * * * *